US008985908B2

(12) United States Patent
Kuivamäki et al.

(10) Patent No.: US 8,985,908 B2
(45) Date of Patent: Mar. 24, 2015

(54) DEVICE MEANT FOR FORCING PILES INTO THE GROUND

(75) Inventors: Pentti Kuivamäki, Hyvinkää (FI); Mikko Lindeman, Hämeenlinna (FI)

(73) Assignee: Movax Oy, Hämeenlinna (FI)

( * ) Notice: Subject to any disclaimer, the term of this patent is extended or adjusted under 35 U.S.C. 154(b) by 0 days.

(21) Appl. No.: 13/642,195

(22) PCT Filed: Apr. 19, 2011

(86) PCT No.: PCT/FI2011/000024
§ 371 (c)(1),
(2), (4) Date: Dec. 13, 2012

(87) PCT Pub. No.: WO2011/131824
PCT Pub. Date: Oct. 27, 2011

(65) Prior Publication Data

US 2013/0121771 A1 May 16, 2013

(30) Foreign Application Priority Data

Apr. 19, 2010 (FI) ..... 20100161

(51) Int. Cl.
*E02D 7/18* (2006.01)
*E02D 11/00* (2006.01)

(52) U.S. Cl.
CPC . *E02D 7/18* (2013.01); *E02D 11/00* (2013.01)
USPC ..... 405/232; 405/231; 405/272; 405/274; 405/285; 173/53; 173/54; 173/55; 173/132; 173/184

(58) Field of Classification Search
CPC ..... E02D 11/00; E02D 7/18; E02D 7/20
USPC ..... 405/231, 232, 272, 274, 285; 166/77.51, 85.1; 173/1, 25, 49, 53, 54, 173/55, 184, 185
See application file for complete search history.

(56) References Cited

U.S. PATENT DOCUMENTS 5,568,997 A 10/1996 Raunisto
2008/0310923 A1 12/2008 Jinnings et al.

FOREIGN PATENT DOCUMENTS

CN 2911013 6/2007
WO WO 2009035392 3/2009
WO WO 2010/119166 * 10/2010 ..... E02D 7/00

OTHER PUBLICATIONS

International Search Report for PCT/FI2011/000024 dated Jul. 15, 2011.

*Primary Examiner* — John Kreck
*Assistant Examiner* — Carib Oquendo
(74) *Attorney, Agent, or Firm* — Nicholas B. Trenkle; Stites & Harbison PLLC

(57) ABSTRACT

Forcing equipment meant for forcing piles, steel profiles and other elongated objects into the ground which forcing equipment comprises a body (1) which can be attached to a working machine, a vibration device (6) attached to the body (1) with the help of damper cushions (9) and moveable grip jaws (10) adjusted to the mentioned vibration device (6) in order to grip the object to be forced at least with a side grip. The body (1) comprises an upper part (2) including an attachment arrangement (4), (5) for attaching it to the working machine and side parts directed from the upper part (2) downwards between which side parts the vibration device (6) and grip jaws (10); (17, 18) can be attached through cassette (7) comprising damping rubbers (9) in which case the attachments comprise pin/hole attachments (11, 23, 14); (20, 8) or (21, 8) which can be opened by detaching the mentioned pins (11, 20, 21).

7 Claims, 2 Drawing Sheets

DEVICE MEANT FOR FORCING PILES INTO THE GROUND

The invention relates to a forcing equipment meant for forcing piles, steel profiles and other elongated objects into the ground which forcing equipment comprises a body adaptive to a power machine, a vibration device attached to the body with the help of damper cushions and moveable grip jaws adjusted to the mentioned vibration device in order to grip the object to be forced at least with a side grip.

Forcing devices according to the above mentioned preamble are previously known in which forcing devices a vibration device is attached to the body of the forcing device with the help of damper cushions and another body is attached to the body of the forcing device in which case the other body surrounds partly the mentioned vibration device. Grip jaws are attached to the other body either to be stiff or to be turned with the help of a joint. A Finnish patent publication nr 106219 (corresponding to PCT/FI11992/00259-WO93/07341 and U.S. Pat. No. 5,568,997) can be mentioned as an example.

In these solutions the whole structure must be disassembled if the vibration device needs to be changed. It is difficult to change the grip jaws because the moveable jaw can be changed only when the structure is disassembled and the change of the fixed jaw also demands the change of the other body at the same time. Usually in the known solutions the jaws are not changed. Instead the grip pieces of the jaws can be changed and then pieces with slightly different forms can be changed to replace them—if needed, such as for example when one forces round piles which have two slightly different diameter sizes. In the known solutions the vibration device is also not changed into a device of a second power class but a totally smaller of bigger forcing device will be provided.

In order to remove these disadvantages, a new forcing device has been developed which forcing device solves many problems related to the forcing devices and eases essentially the modifiability of the forcing device. It is characteristic of the invention that the body comprises an upper part including an attachment arrangement for attaching it to a working machine and comprises side parts directed from the upper part downwards between which side parts the vibration device and the grip jaws can be attached through cassettes comprising damping rubbers in which case the attachments comprise pin/hole attachments which can be opened by detaching the mentioned pins.

The advantage of the invention is the fact that thanks to a new type of a body chosen for the forcing device the vibration device with the grip jaws or only the grip jaws can be detached and changed.

When the vibration devices are thus interchangeable so that the distance s of their damper cushions stays constant in spite of the power class of the vibration device, vibration devices with various power classes can easily be changed into the forcing device. Similarly the grip jaws are congruent regarding their back part in other words their attachment in which case they are grip jaws which can be easily changed and are formed according to the objects to be forced. When the grip jaws are adjusted to the objects regarding their form the damages of the objects to be forced can be avoided during the forcing situations.

In the following the invention is described more detailed by referring to the accompanying drawings in which FIG. 1 shows a body of a forcing device.

Figure 1:
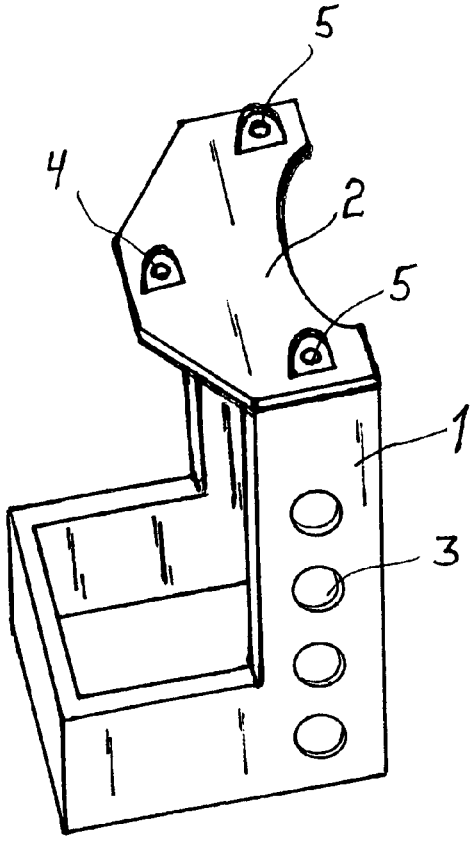

In the FIG. 1 there is a body 1 of the forcing device according to the invention on top of which body there is clip an attachment plate 2 for attaching it to a power machine, such as to an excavator through attachment elements 4, 5. There are gaps holes 3 in the body 1 to which gaps holes some parts of the damper cushions of the vibration device are located for attaching the vibration device 6 to this body.

Figure 2:
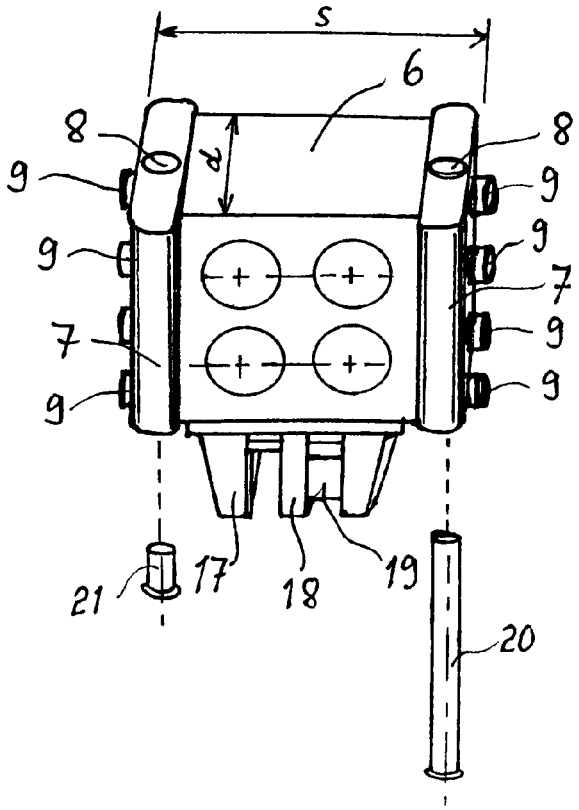
FIG. 2 shows a vibration device which can be adjusted inside the body of the forcing device of the FIG. 1.

In the FIG. 2 a vibration device 6 which can easily be changed and is adaptive inside the body 1 of the FIG. 1 is shown of which vibration device it is characteristic that the measure s stays constant although the power class of the device changes. Several vibration devices 6 of various power classes can thus be adjusted to the forcing device if various forcing powers are needed. The weights or the width d included in the vibration device 6 can change when the power class changes. Damper cushions 9 are attached to the sides of the vibration device 6 as structural cassettes 7 in which case these cassettes 7 are attached to be opened easily to the sides of the vibration device 6. Also gaps holes 8 have been directed through these cassettes 7 through which holes joint pins 20 or 21 related to the attachment of the grip elements as jaws 10 can be adjusted. There is a jaw 10 at the base of the vibration device 6 with which jaw 10 one can force from the top of the pile or pull the pile up. The jaw 10 comprises a fixed part 17, a moveable part 18 and a cylinder 19 which moves the moveable part 18.

Figure 3:
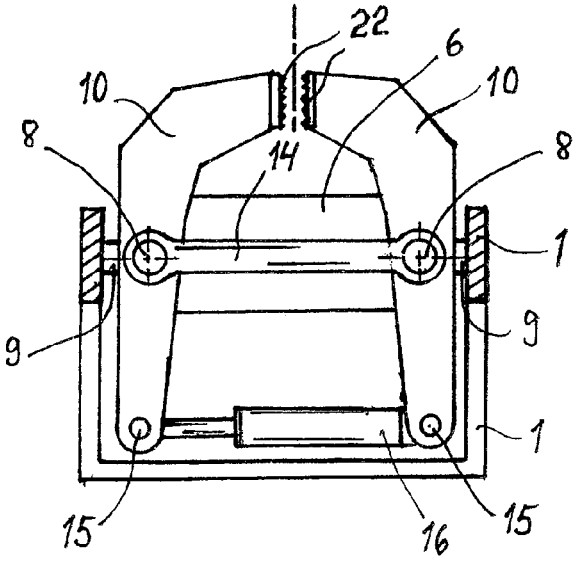
FIG. 3 shows a forcing device seen from above when the body is partly cut out.

In the FIG. 3 a vibration device 6 located between the body 1 is shown which vibration device is attached to the body 1 with the help of damper cushions 9. The arms of the grip jaws 10 are located on top of the damper cushion cassette 7 and underneath it. The holes 8 go through both the band 14, the hole of the grip jaws 10, through the hole of the cassette 7 and underneath correspondingly through the holes of the grip jaws 10 and further through the band 14 of the lower part. The attachment can be done with a long joint pin 20 which penetrates all the parts or with short pins 21 which are separately below or above.

The moving of the grip jaws 10 is made with the help of a cylinder 16 the heads of which are attached to pivots 15. The cylinder 16 can be either at the upper or the lower part of the forcing device or at both parts or also at various heights of the long pin 12. The grip jaws 10 comprise gripping pieces 22 which become in contact with the forced object.

Figure 4:
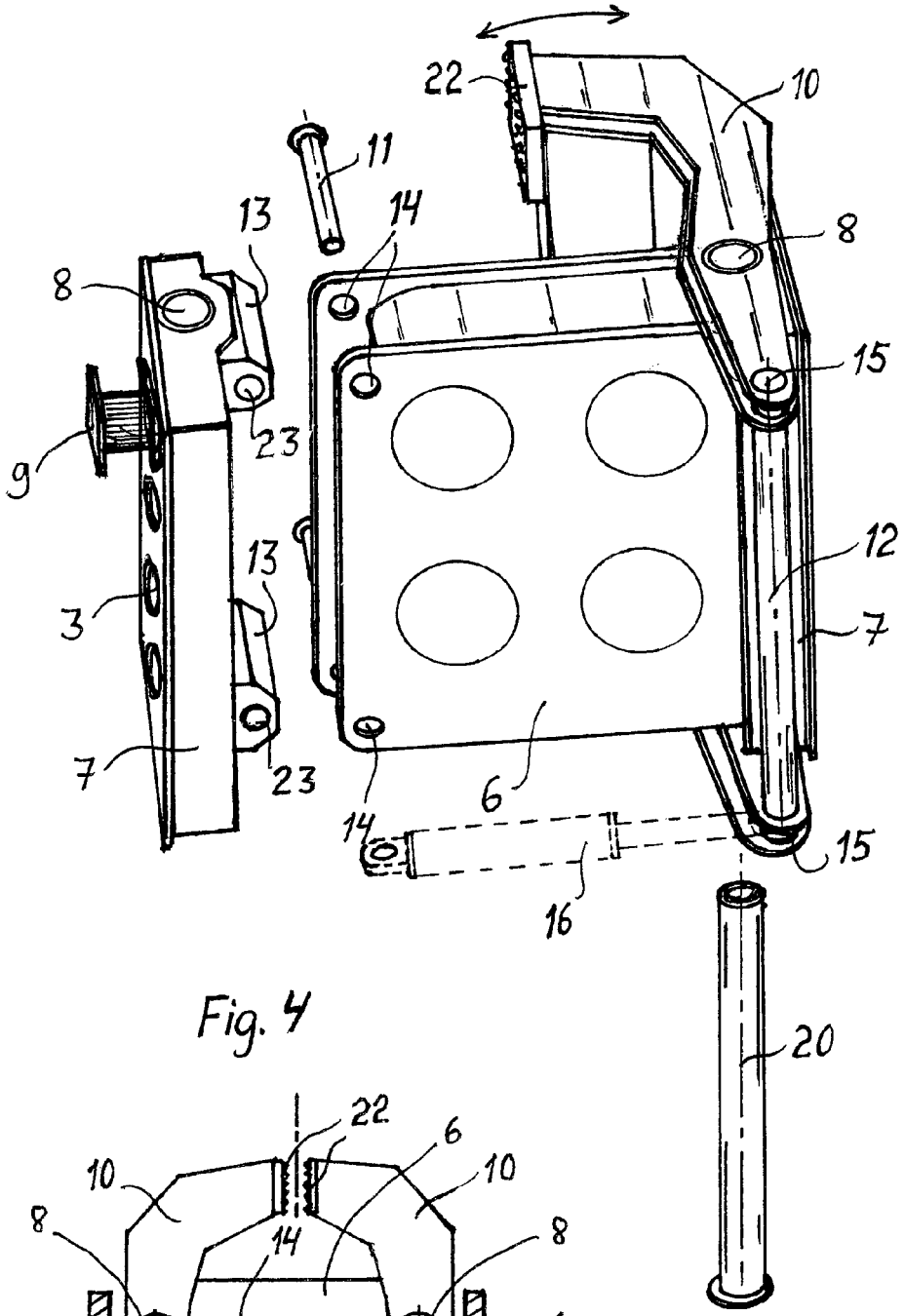
FIG. 4 shows a forcing device diagonally seen and partly disassembled.

It becomes clear from the FIG. 4 how the vibration device 6 can be detached with the grip jaws 10 from the cassette 7 which is attached to the sides of the body 1 through rubber cushions 9. When the pins 11 are detached from the holes of the vibration device 6 and from the holes 23 in the pieces 13 of the cassette 7, the vibration device 6 comes loose from the cassette 7 for example downwards. It is possible to detach only the grip jaws 10, too, when the pins 20 or 21 are detached and also the long pins 12 running through the heads of the cylinders 16 and through the pivots 15 are detached.

The changing of the grip jaws 10 can easily be done when the joint pins 20 or 21 have been removed. Possibly the cylinder 16 must be detached. Also the band 14 comes loose when the joint pins 20 or 21 are being detached. It is easy to use a grip jaw series with the forcing device which grip jaw series has jaws 10 for various objects to be forced because the jaws 10 can easily be changed.

The invention claimed is:

1. A forcing equipment for forcing piles, steel profiles and other elongated objects into a ground, which forcing equipment comprises:

a body including an upper part having an attachment arrangement for attaching the upper part to a working machine, and first and second side parts directed downwards from the upper part;

a vibration device;

first and second moveable grip jaws which are closed in order to grip the object to be forced at least with a side grip;

first and second cassettes to which the vibration device and the first and second movable grip jaws are mounted, said first and second cassettes having damping rubbers through which the vibration device and the first and second movable grip jaws are attached between the first and second side parts;

first and second pin/hole attachment mechanisms by which the vibration device is mounted to the first and second cassettes, the first and second pin/hole attachment mechanisms including aligned mount holes in the vibration device and cassette when the vibration device is provided between the cassettes and mount pins which are received in the aligned mount holes, and third and fourth pin/hole attachment mechanisms by which the first and second movable grip jaws are attached to the first and second cassettes, the third and fourth pin/hole attachment mechanisms including aligned joint holes in the cassette and a pivot point of the first and second movable grip jaws when the first and second movable grip jaws are provided on the cassettes and joint pins which are received in the aligned joint holes, where the aligned joint holes and joint pins therein are positioned so that the mounted vibration device is therebetween and hence pivot axes of the first and second movable grip jaws are likewise located so that the mounted vibration device is therebetween; and whereby the first, second, third and fourth pin/hole attachment mechanisms are opened by removing the associated mount and joint pins thereof.

2. The forcing equipment according to the claim 1, wherein the first and second grip jaws can be detached, removed or changed after the detachment of the joint pins while the vibration device stays attached in its place in the body.

3. The forcing equipment according to the claim 1, wherein a variety of cassettes are attachable to opposite sides of the vibration device the first and second pin/hole attachment mechanisms.

4. The forcing equipment according to the claim 1, wherein the first cassette and first movable grip jaw are attached to the vibration device with a long joint pin extending through the first cassette, and wherein the second cassette and the second movable grip jaws are attached to the vibration device with two short joint pins opposite to one another.

5. The forcing equipment according to the claim 1, wherein the first and second movable grip jaws can be detached at an upper and lower part of the vibration device after joint pins of the the associated third and fourth pin/hole attachment mechanisms have been detached.

6. The forcing equipment according to the claim 1, wherein the first and second movable grip jaws can be detached when a cylinder and intermediate pins about which each jaw pivots relative to the cylinder have been detached.

7. The forcing equipment according to the claim 1 wherein the mount pins of the first and second attachment mechanisms attaching the first and second movable grip jaws are connected to each other with a band.

* * * * *